United States Patent [19]

Spodig

[11] 4,273,646

[45] Jun. 16, 1981

[54] MAGNETIC SEPARATOR HAVING INTERSECTING CONVEYOR BELTS

[76] Inventor: Heinrich Spodig, Netteberge 202, D-4714 Selm/Westf, Fed. Rep. of Germany

[21] Appl. No.: 24,651

[22] PCT Filed: Mar. 19, 1979

[86] PCT No.: PCT/DE78/00010

§ 371 Date: Apr. 4, 1979

§ 102(e) Date: Mar. 19, 1979

[87] PCT Pub. No.: WO79/00085

PCT Pub. Date: Feb. 22, 1979

[30] Foreign Application Priority Data

Aug. 4, 1977 [DE] Fed. Rep. of Germany ..... 2735150

[51] Int. Cl.[3] ..... B03C 1/22

[52] U.S. Cl. ..... 209/223 R

[58] Field of Search ..... 209/219, 223 R, 222, 209/223 A; 210/222, 223

[56] References Cited

U.S. PATENT DOCUMENTS

| | | | |
|---|---|---|---|
| 750,594 | 1/1904 | Campbell | 209/223 R |
| 815,113 | 3/1906 | Odling | 209/223 R |
| 825,672 | 7/1906 | Moffatt | 209/223 R |
| 1,068,453 | 7/1913 | Roward | 209/219 |
| 1,130,648 | 3/1915 | Ullrich | 209/223 R |
| 1,490,792 | 4/1924 | Woodworth | 209/223 R |
| 1,565,038 | 12/1925 | Ullrich | 209/223 R |
| 2,591,122 | 4/1952 | Blind | 209/223 R |
| 2,724,504 | 11/1955 | Blind | 209/223 R |
| 3,042,205 | 7/1962 | Merwin | 209/223 R X |
| 3,948,764 | 4/1976 | Spodig | 209/219 |

FOREIGN PATENT DOCUMENTS

| | | | |
|---|---|---|---|
| 2612834 | 9/1979 | Fed. Rep. of Germany | 209/223 R |
| 251821 | 5/1926 | United Kingdom | 209/223 R |
| 724621 | 2/1955 | United Kingdom | 209/222 |

*Primary Examiner*—Robert Halper

[57] ABSTRACT

A magnetic separator having intersecting conveyor belts, in which the lower belt is used to transport the material to be separated, while the upper belt discharges the separated material, and in which a frame having a closed permanent-magnet system is arranged on each side of the discharge belt, each frame consisting of four directionally magnetized block magnets connected together in pairs by means of soft-iron parts, and of soft-iron intermediate parts connected together by soft-iron pole-pieces forming a working air-gap.

6 Claims, 2 Drawing Figures

MAGNETIC SEPARATOR HAVING INTERSECTING CONVEYOR BELTS

The present invention relates to a magnetic separator having intersecting conveyor belts, in which the lower belt serves to transport the material to be separated, while the upper belt discharges the separated material.

Magnetic separators for separating substances of different magnetic excitability, and using intersecting conveyor means, are known, for example from German Pat. No. 180 923, the said separators comprising magnetically influenced drums arranged above, and at right angles to, a feed belt. In an arrangement of this kind, large scatterfield losses are unavoidable, and the separating efficiency is therefore relatively low.

In another known installation (German Utility Model No. 17 66 101), a conveyor belt for the material to be separated is arranged below a second belt, located at right anlges thereto, for the separated material, an electro-magnet being arranged within the belt, and the discharge end being provided with discharge poles. Here again, the scatter losses are considerable.

In contrast to this, it is the purpose of the invention, in the case of magnetic separators having intersecting conveyor belts, to reduce considerably the scatter losses occurring in known installations, and thus to achieve increased efficiency.

In the case of a magnetic separator of the type mentioned at the beginning hereof, this purpose is achieved, according to the invention, in that, arranged on each side of the discharge belt is a frame having a closed permanent-magnet system, each frame consisting of four directionally-magnetized block magnets connected in pairs by means of soft iron parts, and of soft-iron intermediate parts connected together by soft-iron pole pieces constituting a working air-gap.

It is desirable that the soft-iron parts arranged above the lower run of the discharge belt be of wedge-shaped cross section, and for the soft-iron part arranged below the upper run of the conveyor belt to be of prismatic cross section. Where several discharge belts are provided, the upper soft-iron part may have a plurality of wedge-shaped cross sections associated with each belt, while the lower soft-iron part may have a plurality of prismatic cross sections associated with each belt.

Where at least two discharge belts are arranged side by side, the wedge-shaped cross sections are preferrably arranged at different heights above the conveyor belt. It is also desirable for the distance between the said wedge-shaped cross sections and the conveyor belt to decrease in the direction of travel of the said conveyor belt.

The object of the invention is described hereinafter in greater detail, in conjunction with the example of embodiment illustrated in the drawing, wherein.

Figure 1:
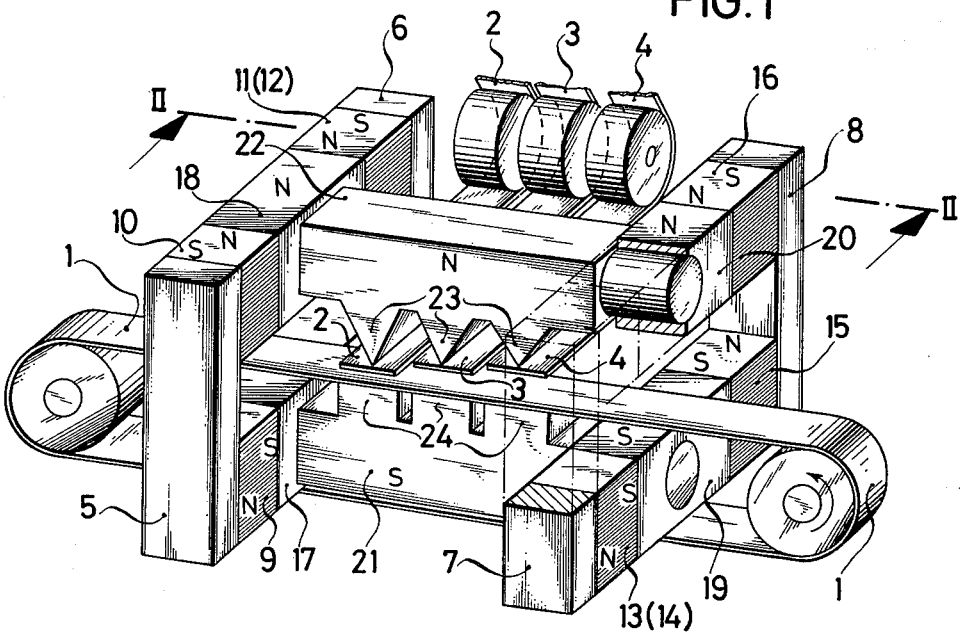
FIG. 1 is a diagrammatic representation, in part section, of the magnetic separator, with one conveyor belt for the material to be separated and three discharge belts for the separated material.
Figure 2:
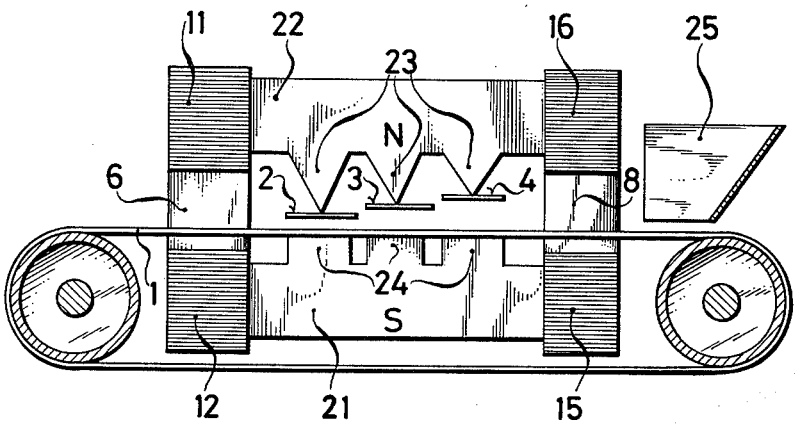
FIG. 2 is a section through the magnetic separator along the line A—A in FIG. 1.

According to FIG. 1, the magnetic separator consists of a closed permanent-magnet circuit arrangement, an endless conveyor belt 1 for the material to be separated, and three endless discharge belts 2, 3, 4 for removing the separated material, the said discharge belts running at right angles to conveyor belt 1. The magnetic-circuit arrangement consists of frames arranged on each side of the discharge belts 2, 3, 4 the said frames consisting of block magnets 9,10;11,12 and 13,14;15,16 connected together by means of soft-iron parts 5,6 and 7,8 and of soft-iron intermediate parts 17,18 and 19,20. The said frames are connected together by pole-pieces 21,22 which are permanently connected, in good magnetic conductivity, to intermediate parts 17,19 and 18,20, the said intermediate parts being far enough apart to accommodate conveyor belt 1 and discharge belts 2,3,4. Within each closed frame, the polarities of the block magnets 9,10;11,12 and 13,14;15,16 are arranged in such a manner that intermediate parts 18,20 have multiple N-polarity, while intermediate parts 17,19 have multiple S-polarity, or vice-versa, induced into them. As a result of this, a highly concentrated magnetic field arises between pole-pieces 21,22 in the area where belts 1,2,3,4 pass therethrough.

Above the lower run of discharge belts 2,3,4 pole-piece 22 is divided into wedge-shaped cross sections 23, whereas pole-piece 21, facing it under the upper run of conveyor belt 1, has corresponding prismatic cross sections 24.

Opposite these prismatic cross sections 24, at the apices of wedge-shaped cross sections 23, the magnetic field is so concentrated that particles of iron in the material on conveyor belt 1 jump, in the said magnetic field, only towards those apices, are therefore removed by the discharge belts from the magnetic field, and are thus separated. The material to be separated is fed to conveyor belt 1 from hopper 25.

According to one special configuration of pole-piece 22, wedge-shaped cro-s sections 23 are arranged at different heights, as are discharge belts 2,3,4. In order to achieve separation in stages, wedge-shaped cross sections 23 are arranged in such a manner that the distance between them and conveyor belt 1 decreases in the direction of travel of the latter. The separation in the first of these magnetic-field stages is coarse, in the second it is finer, and in the third it is very fine.

Depending upon the nature of the material to be separated, and upon the magnetizability of the material therein, optimal separating results may be obtained in this way.

I claim:

1. A magnetic separator having intersecting, elongated, endless conveyor belt means positioned one above the other with each said conveyor belt means being defined by an upper and lower run, the lower belts means serving to transport the material to be separated and the upper belt means serving as discharge means for the separated material as well as first and second soft-iron pieces forming the working gap and being magnetized in opposite directions by a magnetic system with the first pole piece being arranged below the upper run of the lower belt means and the second pole piece being arranged above the lower run of the upper belt means, the first pole piece having a pole surface of large area and the second pole piece having at least one smaller pole surface for concentrating the magnetic flux and extending in the longitudinal direction of the upper belt means, said magnetic system comprising two frames that are spaced apart in the direction of the lower belt means with each of said frames surrounding the upper run of the lower belt means, one of said frames being arranged along each of the longitudinal sides of the upper belt means, said frames comprising two symmetrical halves of alternatingly successive permanent magnets and soft-iron parts, said frames being connected by said two first mentioned soft-iron pole pieces.

2. The magnetic separator according to claim 1 wherein one of the permanent magnets is provided in each corner area of the frames and the adjacent corners of the frames which are, respectively, above and below the upper run of the lower belt means are connected by the soft-iron parts to form confronting frame halves that straddle the upper run of the lower belt means, said frame halves being connected to one another above and below the upper run of the lower belt means by further soft-iron pole parts which, on their part, are connected by the first two mentioned soft-iron pole pieces.

3. The magnetic separator according to claim 1 wherein the upper belt means is comprised of a plurality of individual belts each of which has differently sized pole areas.

4. The magnetic separator according to claim 3 wherein the large-area pole surface has a prismatic shape and the smaller-area pole surface is wedge-shaped in cross-section.

5. The magnetic separator according to claim 4 wherein the wedge-shaped cross-section of the pole surfaces associated with the adjacent upper belt means are respectively arranged at different heights above the lower belt means.

6. The magnetic separator according to claim 5 wherein the adjacent upper belt means are arranged at different heights above the lower belt means.

* * * * *